US009213249B2

(12) United States Patent
Kadonome et al.

(10) Patent No.: US 9,213,249 B2
(45) Date of Patent: Dec. 15, 2015

(54) ELECTROSTATIC LATENT IMAGE DEVELOPING TONER, PRODUCTION METHOD OF THE TONER FOR ELECTROSTATIC LATENT IMAGE DEVELOPMENT AND ELECTROPHOTOGRAPHIC IMAGE FORMATION METHOD

(71) Applicant: Konica Minolta, Inc., Tokyo (JP)

(72) Inventors: Futoshi Kadonome, Hachioji (JP); Yukio Hosoya, Tama (JP); Kazue Nakamura, Hino (JP); Saburou Hiraoka, Kodaira (JP); Yasuko Uchino, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 40 days.

(21) Appl. No.: 14/284,842

(22) Filed: May 22, 2014

(65) Prior Publication Data

US 2014/0349228 A1 Nov. 27, 2014

(30) Foreign Application Priority Data

May 24, 2013 (JP) ..... 2013-109533

(51) Int. Cl.

| | |
|---|---|
| ***G03G 9/097*** | (2006.01) |
| ***G03G 9/08*** | (2006.01) |
| ***G03G 13/06*** | (2006.01) |
| ***G03G 13/00*** | (2006.01) |

(52) U.S. Cl.

CPC ..... *G03G 9/0819* (2013.01); *G03G 9/0802* (2013.01); *G03G 9/09708* (2013.01); *G03G 9/09791* (2013.01); *G03G 13/00* (2013.01); *G03G 13/06* (2013.01)

(58) Field of Classification Search

CPC ..... G03G 13/00; G03G 13/06; G03G 13/08; G03G 13/0802; G03G 13/0819

See application file for complete search history.

(56) References Cited

U.S. PATENT DOCUMENTS

2009/0130582 A1* 5/2009 Handa ..... G03G 9/09733 430/108.3

FOREIGN PATENT DOCUMENTS

| | | |
|---|---|---|
| JP | 2000-089502 A | 3/2000 |
| JP | 2001-100452 | 4/2001 |

(Continued)

OTHER PUBLICATIONS

Office Action dated Apr. 21, 2015 issued from the corresponding Japanese patent application No. 2013-109533.

(Continued)

*Primary Examiner* — Peter Vajda
(74) *Attorney, Agent, or Firm* — Lucas & Mercanti, LLP

(57) ABSTRACT

A toner for electrostatic latent image development of the present invention includes toner particles containing toner mother particles and an external additive. The external additive contains fatty acid metal salt particles, and a volume based particle diameter (size) distribution of the fatty acid metal salt particles has two peaks on a side of smaller size and a side of larger size, respectively. A volume based mean particle diameter of the fatty acid metal salt particles having the peak on the side of smaller size is 3.0 μm or smaller and a volume based mean particle diameter of the fatty acid metal salt particles having the peak on the side of larger size is larger than a volume based mean particle diameter of the toner mother particles.

9 Claims, 2 Drawing Sheets

(56) References Cited

FOREIGN PATENT DOCUMENTS

| | | | |
|---|---|---|---|
| JP | 2004-163807 | | 6/2004 |
| JP | 2006-259389 | | 9/2006 |
| JP | 2006-330562 | | 12/2006 |
| JP | 2007-108622 | A | 4/2007 |
| JP | 2010-102057 | A | 5/2010 |
| JP | 2011-203666 | A | 10/2011 |
| JP | 2012-083448 | A | 4/2012 |
| JP | 2013-061571 | | 4/2013 |

OTHER PUBLICATIONS

English translation of Office Action dated Apr. 21, 2015 issued from the corresponding Japanese patent application No. 2013-109533.

* cited by examiner

ELECTROSTATIC LATENT IMAGE DEVELOPING TONER, PRODUCTION METHOD OF THE TONER FOR ELECTROSTATIC LATENT IMAGE DEVELOPMENT AND ELECTROPHOTOGRAPHIC IMAGE FORMATION METHOD

TECHNICAL FIELD

The present invention relates to an electrostatic latent image developing toner (toner for electrostatic latent image development), a method for producing the toner for electrostatic latent image development and a method for forming an electrophotographic image using the toner for electrostatic latent image development. More specifically, the present invention relates to a toner for electrostatic latent image development that is capable of suppressing one-sided wearing of an electrophotographic photoreceptor and a cleaning blade and thus obtaining fine images without decreasing life of a cleaning blade, a method for producing the toner for electrostatic latent image development and a method for forming an electrophotographic image using the toner for electrostatic latent image development.

BACKGROUND ART

In a conventional electrophotographic image forming device, friction between a surface of an electrophotographic photoreceptor (referred to also as "photoreceptor", hereinafter) and a cleaning blade is reduced by supplying a lubricant onto a surface of the electrophotographic photoreceptor so as to prevent a toner for electrostatic latent image development (referred to also as "toner", hereinafter) from escaping and wearing of the surface of the photoreceptor.

Examples of a method for supplying a lubricant onto a surface of a photoreceptor are (1) using a lubricant application system (applicator), (2) adding a lubricant in a surface layer of a photoreceptor, and (3) adding a lubricant in a developer containing a toner so as to supply the lubricant onto the surface of the photoreceptor at the same time of development.

As for the method (1) using a lubricant application system, an applicator to supply a lubricant on a surface of a photoreceptor may be provided. Although the method has a merit that a lubricant can be supplied on the whole surface of a photoreceptor evenly without influence of blackening area rate of an output image, it makes the image forming device become large and complicated because it necessitates a dedicated device and space and further it causes troublesome maintenance work because uneven lubricant application may occur because a part may be degraded and lubricant refilling means becomes necessary.

When using the method (2) that adds a lubricant in a surface layer of a photoreceptor, although it is effective to suppress wearing of a surface of a photoreceptor to a certain extent, surface characteristics of a photoreceptor varies partially such as partial decrease of sensitivity may occur and thus image defect may be induced.

A method to add a lubricant in a toner is proposed as the method (3). The method, although a toner may aggregate under the presence of excess lubricant and under high temperature and humidity and may cause image deficiency of black spots on a final image, is widely adopted to many types of electrophotographic image forming devices because the method can make the device small and a lubricant can be readily supplied by the method.

Conventionally, a fatty acid metal salt is preferably used as a lubricant of the method (3). Because the slipping property of the salt is preferable, stability of a blade cleaning and suppress of uneven wearing (one-sided wearing) have been examined. For example, Patent Literature 1 discloses a technique to form a fine image without image defect by adding particles of fatty acid metal salt having a diameter of 3 to 15 μm as external additives in toner mother particles so as to increase cleaning ability, suppress wearing of surface of a photoreceptor caused by surface scrubbing with a cleaning blade and stabilize charging property of the toner.

However, if a size of the particles of the fatty acid metal salt is large, the particles of the fatty acid metal salt cannot adhere to the toner mother particles and exist free. As a result, the particles of the fatty acid metal salt adhere to non-image portion on the photoreceptor and are not supplied to a toner developing portion (image portion). Thus the particles of the fatty acid metal salt are not supplied on the whole surface of the photoreceptor.

Patent Literatures 2 to 5 disclose a technique that particles of a fatty acid metal salt having a diameter smaller than a diameter of toner mother particles are externally adhered to the toner mother particles and thus the particles of a fatty acid metal salt are supplied to a toner developing portion on a surface of a photoreceptor with the toner particles at a developing stage.

According to the above art, the particles of a fatty acid metal salt are supplied to the toner developing portion. However, the particles of a fatty acid metal salt are not supplied to a non-developing portion and thus a lubricant is supplied unevenly on the surface of a photoreceptor. As a result, the photoreceptor or cleaning blade is unevenly worn (wearing occurs partially) and it causes decreased life of the cleaning blade. The phenomenon becomes a problem particularly under the circumstance of low temperature and low humidity.

PRIOR ART LITERATURE

Patent Literature

Patent Literature 1: JP2000-089502A
Patent Literature 2: JP2012-083448A
Patent Literature 3: JP2011-203666A
Patent Literature 4: JP2010-102057A
Patent Literature 5: JP2007-108622A

SUMMARY OF THE INVENTION

Problem to be Solved by the Invention

The present invention was made in view of above problem and an object is to provide a toner for electrostatic latent image development that is capable of suppressing wearing (abrasion) of a cleaning blade, causes no insufficient cleaning or image defect of black spots due to one-sided wearing of the cleaning blade and photoreceptor and can form fine images stably, a method for producing the toner for electrostatic latent image development and a method for forming an electrophotographic image using the toner for electrostatic latent image development.

Means to Solve the Problem

The present inventors have found that, in a process to investigate reasons of the above problem, the problem can be solved by a toner for electrostatic latent image development that contains small-sized fatty acid metal salt particles and large-sized fatty acid metal salt particles.

The problem is solved by the following means.

To achieve at least one of the above mentioned objects, a toner for electrostatic latent image development reflecting one aspect of the present invention includes toner particles containing toner mother particles and an external additive. The external additive contains fatty acid metal salt particles, and a volume based particle diameter (size) distribution of the fatty acid metal salt particles has two peaks on a side of smaller size and a side of larger size, respectively. A volume based mean particle diameter of the fatty acid metal salt particles having the peak on the side of smaller size is 3.0 μm or smaller and a volume based mean particle diameter of the fatty acid metal salt particles having the peak on the side of larger size is larger than a volume based mean particle diameter of the toner mother particles.

Preferably, the volume based mean particle diameter of the fatty acid metal salt particles having the peak on the side of smaller size is within a range of 1.0 to 3.0 μm and the volume based mean particle diameter of the fatty acid metal salt particles having the peak on the side of larger size is within a range of 8.0 to 15.0 μm.

Preferably, a kind of the fatty acid metal salt particles is at least one selected from the group consisting of zinc stearate particles, lithium stearate particles and magnesium stearate particles.

Preferably, a content of the fatty acid metal salt particles is within a range of 0.01 to 0.50 part by mass relative to 100 parts by mass of the toner mother particles.

Preferably, a content rate of the fatty acid metal salt particles having the peak on the side of smaller size is within a range of 50 to 70% by mass relative to whole of the fatty acid metal salt particles.

Preferably, the toner particles contain the fatty acid metal salt particles and metal oxide fine particles, and the metal oxide fine particles are selected from a group consisting of silica fine particles, alumina (aluminum oxide) fine particles, cerium oxide fine particles, calcium titanate fine particles, and strontium titanate fine particles. A number based mean primary diameter of the metal oxide fine particles is preferably within a range of 100 to 300 nm.

Preferably, a volume based mean particle diameter of the toner mother particles is within a range of 5.0 to 8.0 μm.

To achieve at least one of the above mentioned objects, a method for producing the toner for electrostatic latent image development reflecting one aspect of the present invention includes a step of mixing fatty acid metal salt particles, into toner mother particles, having a volume based mean particle diameter smaller than a volume based mean particle diameter of the toner mother particles, and a step of mixing fatty acid metal salt particles having a volume based mean particle diameter larger than the volume based mean particle diameter of the toner mother particles.

To achieve at least one of the above mentioned objects, a method for forming an electrophotographic image reflecting one aspect of the present invention includes steps of:

charging an electrophotographic photoreceptor, exposing so as to form an electrostatic latent image on the electrophotographic photoreceptor, developing the latent image so as to form a toner image using a negative-charged toner for developing the electrostatic latent image, transferring the toner image on a transfer medium, and cleaning the electrophotographic photoreceptor using a cleaning blade after transferring the toner image, in which the toner for developing the electrostatic latent image is the toner for electrostatic latent image development above described, the electrophotographic photoreceptor has a surface protecting layer on a photosensitive layer, the surface protecting layer contains metal oxide fine particles and a resin obtained by polymerizing a cross-linking-type polymerizable compound, and the metal oxide fine particles are selected from the group consisting of silica fine particles, titania fine particles and tin oxide fine particles.

EMBODIMENTS TO CARRY OUT THE INVENTION

Figure 1:
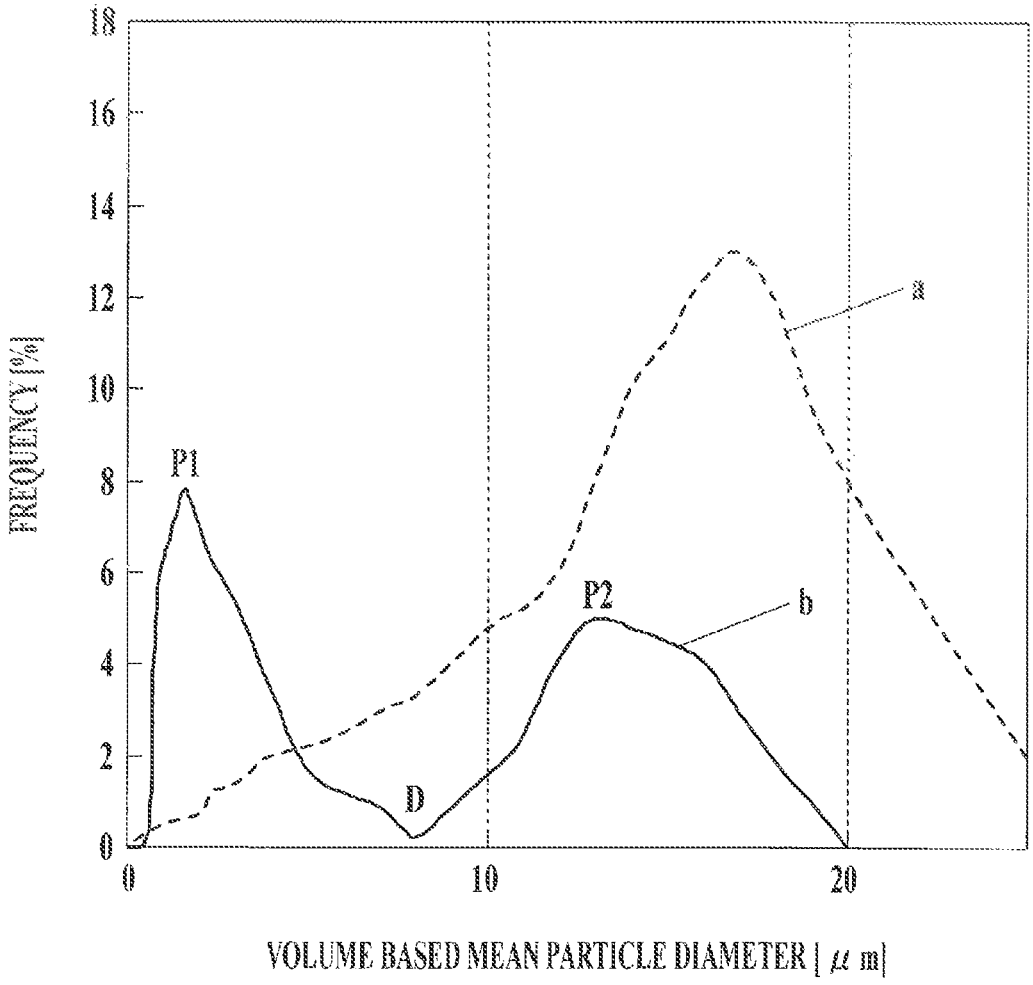
FIG. 1 is a graph for explaining an example of a particle diameter (size) distribution of fatty acid metal salt particles having peaks on a side of smaller size and a side of larger size.

The toner for electrostatic latent image development is a toner for electrostatic latent image development which includes toner particles containing toner mother particles and an external additive. The external additive contains fatty acid metal salt particles, and a volume based particle size distribution of the fatty acid metal salt particles has two peaks on a side of smaller size and a side of larger size, respectively. A volume based mean particle diameter of the fatty acid metal salt particles having a peak on the side of smaller size is 3.0 μm or smaller and a volume based mean particle diameter of the fatty acid metal salt particles having a peak on the side of larger size is larger than a volume based mean particle diameter of the toner mother particles.

The feature is a common technical feature of the inventions of claims 1 to 9.

As an embodiment of the invention, preferably, the volume based mean particle diameter of the fatty acid metal salt particles having a peak on the side of smaller size is 1.0 to 3.0 μm and the volume based mean particle diameter of the fatty acid metal salt particles having a peak on the side of larger size is 8.0 to 15.0 μm.

When the volume based mean particle diameter of the fatty acid metal salt particles having a peak on the side of smaller size is within the above range, the fatty acid metal salt particles are developed in an image portion on an electrophotographic photoreceptor with the toner particles, and when the volume based mean particle diameter of the fatty acid metal salt particles having a peak on the side of larger size is within the above range, the fatty acid metal salt particles are adhered in a non-image portion on an electrophotographic photoreceptor. As a result, the fatty acid metal salt particles can be supplied on the whole surface of the electrophotographic photoreceptor.

When a kind of the fatty acid metal salt particles is at least one selected from the group consisting of zinc stearate particles, lithium stearate particles and magnesium stearate particles, excellent lubricant effect is obtained and thus preferable.

When a content of the fatty acid metal salt particles is 0.01 to 0.50 part by mass relative to 100 parts by mass of the toner mother particles, sufficient lubricant effect is obtained and thus preferable.

When a content of the fatty acid metal salt particles having a peak on the side of smaller size is within a range of 50 to 70% by mass relative to whole fatty acid metal salt particles, the fatty acid metal salt particles can be supplied in both of the image portion and non-image portion on the photoreceptor uniformly and thus preferable.

When the toner particles contain the fatty acid metal salt particles and metal oxide fine particles, and the metal oxide fine particles is selected from a group consisting of silica fine particles, alumina (aluminum oxide) fine particles, cerium oxide fine particles, calcium titanate fine particles and strontium titanate fine particles, and a number based mean primary diameter of the metal oxide fine particles is 100 to 300 nm, it is preferable because a basic capability of the toner such as charging capability and fluidity can be controlled in a desirable range to make the metal oxide fine particles deposit at the tip portion of a cleaning blade to exert cleaning effect as abrasives to a surface of an electrophotographic photoreceptor.

When a volume based mean particle diameter of the toner mother particles is 5.0 to 8.0 μm, it becomes possible to obtain high definition images and is preferable.

A method for producing the toner for electrostatic latent image development including a step of mixing fatty acid metal salt particles, into toner mother particles, having a volume based mean particle diameter smaller than a volume based mean particle diameter of the toner mother particles, and a step of mixing fatty acid metal salt particles having a volume based mean particle diameter larger than the volume based mean particle diameter of the toner mother particles is preferable on the grounds that the resulting toner contains fatty acid metal salt particles having a volume based mean particle diameter distribution having two peaks on a side of smaller size and a side of larger size, respectively, and the peak positions can be controlled arbitrarily.

The toner for electrostatic latent image development of the invention is preferably used for a method for forming an electrophotographic image including the steps of charging an electrophotographic photoreceptor, exposing so as to form an electrostatic latent image on the electrophotographic photoreceptor, developing the latent image so as to form a toner image using a negative-charged toner for developing the electrostatic latent image, transferring the toner image on a transfer medium, and cleaning the electrophotographic photoreceptor using a cleaning blade after transferring the toner image, in which the toner for developing the electrostatic latent image is the toner for electrostatic latent image development above described, the electrophotographic photoreceptor has a surface protecting layer on a photosensitive layer, the surface protecting layer contains a resin obtained by polymerizing cross-linking-type polymerizable compound and metal oxide fine particles, and the metal oxide fine particles are selected from the group consisting of silica fine particles, titania fine particles and tin oxide fine particles.

The present invention, its components and an embodiment to carry out the invention will be described below in detail. In the present application, the expression that designates a numeral range such as "A to B" includes the minimum value A and the maximum value B.

(Toner for Electrostatic Latent Image Development)

The toner for electrostatic latent image development of the present invention is a toner which includes toner particles containing toner mother particles and an external additive. The external additive contains fatty acid metal salt particles and a volume based particle diameter (size) distribution of the fatty acid metal salt particles has two peaks on a side of smaller size and a side of larger size, respectively. A volume based mean particle diameter of the fatty acid metal salt particles having the peak on the side of smaller size is 3.0 μm or smaller and a volume based mean particle diameter of the fatty acid metal salt particles having the peak on the side of larger size is larger than a volume based mean particle diameter of the toner mother particles.

The toner mother particles may contain binder resin and, as necessary, a colorant, releasing agent or charge controlling agent.

Component elements of the toner for electrostatic latent image development of the present invention will be described in turn.

(Fatty Acid Metal Salt Particles)

The toner for electrostatic latent image development of the present invention contains fatty acid metal salt particles as an external additive.

In the present invention, a volume based particle diameter distribution of the fatty acid metal salt particles has two peaks on a side of smaller size and a side of larger size, respectively. A volume based mean particle diameter of the fatty acid metal salt particles having the peak on the side of smaller size is 3.0 μm or smaller and a volume based mean particle diameter of the fatty acid metal salt particles having the peak on the side of larger size is larger than a volume based mean particle diameter of the toner mother particles.

The fatty acid metal salt particles function as a lubricant in the toner. The fatty acid metal salt particles supplied on an electrophotographic photoreceptor are spread on the photoreceptor by a cleaning blade. The fatty acid metal salt particles spread on the photoreceptor as a lubricant increase cleaning capability of transfer residue toner (toner remained on the photoreceptor without transferred on a transfer medium) on the photoreceptor by decreasing friction between the cleaning blade and the surface of the photoreceptor.

A fatty acid metal salt used for the present invention has preferably a Mohs hardness of 2 or smaller from the viewpoint of spreading characteristics on an electrophotographic photoreceptor. A fatty acid salt of a metal selected from zinc, calcium, magnesium, aluminum and lithium is preferable. Among them, fatty acid zinc, fatty acid lithium or fatty acid magnesium is particularly preferable. A higher fatty acid having carbon atoms of 12 to 22 is preferable as a fatty acid of the fatty acid metal salt. When the number of carbon atoms of the fatty acid is 12 or more, it becomes possible to suppress generation of a free fatty acid and when the number of carbon atoms of the fatty acid is 22 or smaller, a melting point of the fatty acid metal salt does not become too large and good fusion capability can be obtained. A stearic acid is particularly preferable as a fatty acid and zinc stearate particles, lithium stearate particles or magnesium stearate particles are preferable as fatty acid metal salt particles of the invention. The same kind of fatty acid metal salt particles may be used for small-sized particles and for large-sized particles. Or different kinds of fatty acid metal salt particles may be used for small-sized particles and for large-sized particles.

In the present invention, two types of fatty acid metal salt particles having different mean particle diameters are preferably used so as to make the fatty acid metal salt particles, to be contained in a toner, having two peaks on a smaller-size side and a larger size side, respectively. The two kinds of particles may be different in the mean particle size only or two kinds of fatty acid metal salt particles that are different in kinds of the fatty acids and the metals may be used in combination.

To reduce the difference in the amount of application between an image portion and a non-image portion, the volume based particle diameter distribution of the fatty acid metal salt particles has two peaks on a smaller-size side and a larger-size side, respectively, and a volume based mean particle diameter of the fatty acid metal salt particles having the peak on the smaller-size side is 3.0 μm or smaller and a volume based mean particle diameter of the fatty acid metal salt particles having the peak on the larger-size side has the peak on a larger-size side than a volume based mean particle diameter of the toner mother particles.

When a volume based mean particle diameter of the fatty acid metal salt particles having the peak on the smaller-size side is 3.0 μm or smaller, the particles exhibit a function to adhere to the toner particles and are developed on an image portion of an electrophotographic photoreceptor. It is preferable that a volume based mean particle diameter of the fatty acid metal salt particles having the peak on the smaller-size side is 1.0 to 3.0 μm. When the size is within the range, developability of the developer (developing agent) is not impaired by spreading the particles on the toner mother particles or carrier particles, and the particles are adhered to the toner mother particles and are developed on the image portion of the electrophotographic photoreceptor with the toner particles.

The volume based mean particle diameter of the fatty acid metal salt particles having the peak on the larger-size side is larger than a volume based mean particle diameter of the toner mother particles. When the volume based mean particle diameter is larger than a volume based mean particle diameter of the toner mother particles, the particles do not adhere to the toner particles and are developed in a non-image portion independent of the toner particles. It is preferable that the volume based mean particle diameter of the fatty acid metal salt particles having the peak on the larger-size side is 8.0 to 15.0 μm. When the size is within the range, the fatty acid metal salt particles do not adhere to the toner mother particles and are developed and adhered to the non-image portion on the electrophotographic photoreceptor at a time of development and thus preferable.

(Measurement of Particle Diameter Distribution and Volume Based Mean Particle Diameter of Fatty Acid Metal Salt Particles)

The particle diameter distribution of the fatty acid metal salt particles added with the toner is obtained by measurement of external additive particles detached from the toner using a flow-type particle image analyzer "FPIA-2100" (Sysmex Corporation) by a following process.

The measurement is carried out from 0.6 to 400 μm. Inorganic external additives added with the toner mother particles have diameters of 0.6 μm or smaller and inorganic external additives other than the fatty acid metal salt particles are not detected. Therefore, the particle diameter distribution measured in the range corresponds to that of the fatty acid metal salt particles.

(1) Dispersion 5 g of toner and 50 ml of 0.7% sodium dodecylbenzene sulfonate water solution are added in a 100 ml beaker and the solution is stirred and dispersed using a magnetic stirrer "Model MS500D" (Yamato Scientific Co., Ltd.) at 300 rpm in 5 minutes.

(2) Detachment of External Additive Particles

After the dispersion, the beaker is subjected to ultrasonic vibration by an ultrasonic homogenizer "US-1200T" (Nihonseiki Kaisha Ltd.) in 10 minutes by setting at a frequency of 20 kHz, OUTPUT gage 3 and TUNING gage 6.

(3) Centrifuge

The toner-dispersed solution is centrifuged using a centrifuge "Model H-900" (Kokusann Co., Ltd.) at 292 G for 10 minutes.

Rotor: PC-400 (18.1 cm in radius)

Rotation rate: 1200 rpm (292 G)

Time: 10 minutes

After the centrifuge the supernatant fluid is sampled by 40 ml. The supernatant should be carefully separated using a pipet so as not to contain the centrifuged toner.

The particle diameters of the external additive particles contained in the supernatant fluid are measured using a flow-type particle image analyzer "FPIA-2100" (Sysmex Corporation) to obtain the particle diameter distribution and the volume based mean particle diameter.

FIG. 1 is a graph for explaining an example of a particle diameter (size) distribution of fatty acid metal salt particles having peaks on a smaller-size side and a larger-size side. A curve depicted by "a" is an example of a particle diameter distribution of fatty acid metal salt particles added in toner mother particles as a conventional external additive. A curve depicted by "b" is an example of a particle diameter distribution of the fatty acid metal salt particles of the present invention having two peaks on a smaller-size side and a larger-size side. The peak on a smaller-size side is depicted by P1 and the peak on a larger-size side is depicted by P2. The point D is a minimum diameter value in the particle diameter distribution curve. The smaller-size side and the larger-size side are divided at the minimum diameter D and the content is calculated. The content of the smaller-size side particles and the larger-size side particles is calculated by dividing the particle diameter distribution curve shown in FIG. 1 at the minimum diameter value D.

Figure 2:
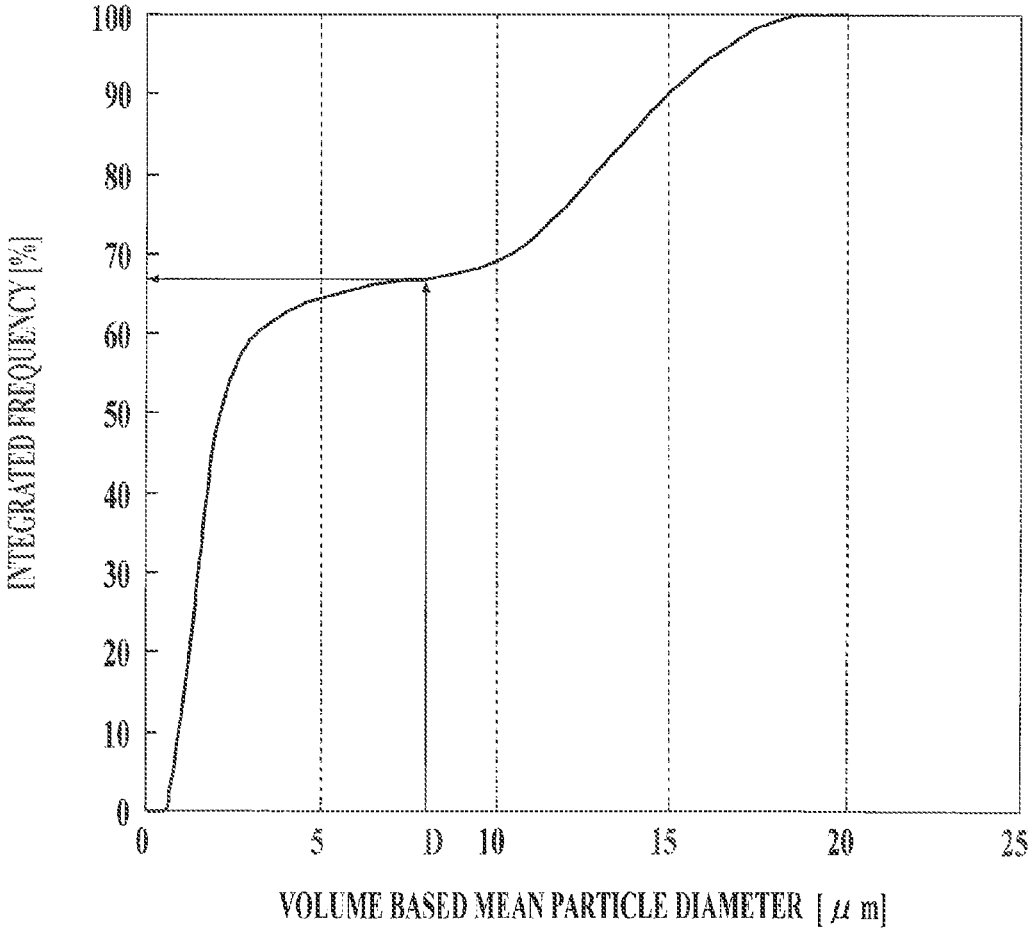
FIG. 2 is a graph showing an integrated frequency value of a size distribution of fatty acid metal salt particles having peaks on a side of smaller size and a side of larger size, which is for explaining a content of fatty acid metal salt particles having a peak on a side of smaller size and fatty acid metal salt particles having a peak on a side of larger size.

FIG. 2 shows an integrated frequency value of the particle diameter distribution of the fatty acid metal salt particles and is for explaining the content of fatty acid metal salt particles having the peak on a smaller-size side and the fatty acid metal salt particles having a peak on a larger-size side. In the graph, the integrated frequency value at the minimum diameter value point D (intersection point at D) in the distribution curve is the content of the fatty acid metal salt particles having the peak on a smaller-size side.

The volume based particle diameter distribution of the fatty acid metal salt particles of the present invention has two peaks on a smaller-size side and a larger-size side, and preferably a content of the fatty acid metal salt particles having a peak on a smaller-size side is 50 to 70% by weight relative to the total amount of the fatty acid metal salt particles. When the ratio is in this range, ratios of the fatty acid metal salt particles supplied to the image portion and the non-image portion become nearly the same and the fatty acid metal salt particles can be supplied in the whole surface of the electrophotographic photoreceptor, and thus preferable.

The content of the particles having a peak on a smaller-size side and the particles having a peak on a larger-size side is a ratio of the values obtained by separating the particle diameter distribution curve of the fatty acid metal salt particles shown in FIG. 1 into two parts of the smaller-size side and the larger-size side relative to the minimum particle diameter D.

A content of the fatty acid metal salt particles in the toner is preferably 0.01 to 0.5 part by mass relative to 100 parts by mass of the toner mother particles. When the content is within this range, sufficient lubrication effect can be obtained.

(Toner Mother Particles)

Any known toner mother particles may be used as the toner mother particles that form the toner for electrostatic latent image development of the present invention. The toner mother particles are composed of at least a binder resin (also referred to as a "toner resin" hereinafter) and colorant as necessary. The toner mother particles may further contain other component (s) such as a releasing agent and a charge controlling agent as necessary.

For the present invention, a volume based mean particle diameter of the toner mother particles of the invention is preferably 5.0 to 8.0 μm. When the diameter is within this range, it becomes possible to obtain high definition images and is thus preferable.

(Binder Resin (Toner Resin))

A thermoplastic resin is preferably used for the binder resin that forms the toner.

Any known binder resin which is generally used as a binder resin to form a toner can be used as the binder resin of the invention, and examples of the resin are styrene resins, acrylic resins such as alkyl acrylate and alkyl methacrylate, styrene-acrylic copolymer resins, polyester resins, silicone resins, olefin resins, amide resins and epoxy resins.

Among them, styrene resins, acrylic resins, styrene-acrylic copolymer resins and polyester resins are preferable because they have a low viscosity and high sharpmelting characteristics. It is preferable to use a styrene-acrylic copolymer resin by 50% or more as a main resin. These resins may be used alone or in combination.

Examples of a polymerizable monomer to obtain the binder resin are styrene monomers such as a styrene, methylstyrene, methoxystyrene, butylstyrene, phenylstyrene and chlorostyrene; acrylate ester monomers such as a methyl acrylate, ethyl acrylate, butyl acrylate and ethylhexyl acrylate; methacrylate ester monomers such as a methyl methacrylate, ethyl methacrylate, butyl methacrylate and ethylhexyl methacrylate; and carboxylic acid monomers such as an acrylic acid, methacrylic acid and fumaric acid.

These monomers may be used alone or in combination.

With regard to the binder resin to form the toner, a glass transition temperature (Tg) is preferably 30 to 50° C. from the viewpoint of fixing properties at low temperature. When the glass transition temperature is within this range, good fixing properties at low temperature and heat resistant shelf life can be obtained.

A glass transition temperature of a binder resin can be measured by using Diamond DSC (PerkinElmer Inc.).

A measurement procedure is as follows. 3.0 mg of a binder resin is enclosed in an aluminum pan and the pan is set on a holder. An empty aluminum pan is used as a reference. Measurement conditions are; temperature: 0 to 200° C., temperature rising rate: 10° C./min, and temperature falling rate: 10° C./min. The temperature controlling is carried out by Heat-Cool-Heat and data at the second Heat step is analyzed.

The glass transition temperature is determined as follows. An extension line of a baseline before a rising point of a first endothermic (heat-absorbing) peak and a tangent line indicating a maximum slope between the rising point of the first peak and a top of the peak are drawn and an intersection of the two lines is defined as the glass transition temperature.

A glass transition temperature (Tg) of a toner can be measured by the same way as that explained above by using a toner as a sample.

A softening temperature (point) of the binder resin is preferably 80 to 130° C. and more preferably 90 to 120° C. The softening temperature can be measured using Flowtester CFT-500D (Shimadzu Corporation).

The softening temperature is measured as follows.

1.1 g of a sample is put on a petri dish and made even under an environment at a temperature of 20±1° C. and relative humidity of 50±5% RH. After standing for 12 hours or more, a cylindrical molded sample having a diameter of 1 cm is formed using a molder SSP-10A (Shimadzu Corporation) by pressing at a load of 3820 kg/cm$^2$ for 30 seconds. The molded sample is then extruded, after pre-heating, from a hole (1 mm of diameter×1 mm) of a cylindrical die of Flowtester CFT-500D (Shimadzu Corporation) under the conditions of a load of 196 N (20 kgf), starting temperature at 60° C., pre-heating time of 300 seconds, and temperature rising speed of 6° C./min using a piston of 1 cm of diameter under the environment of temperature of 24±5° C. and relative humidity of 50±20% RH. An offset-method temperature $T_{offset}$ measured by a temperature-rising melting point measurement method at an offset value of 5 mm is defined as the softening point of the sample.

A softening point of the toner can be measured as the same method as described above using the toner as a sample.

(Colorant)

A known inorganic or organic colorant may be used as a colorant composing the toner.

An amount of the colorant added to the toner is 1 to 30% by mass relative to the whole toner and preferably 2 to 20% by mass.

(Releasing Agent)

The toner may contain a releasing agent. The releasing agent is not limited and examples are a hydrocarbon-based wax such as a polyethylene wax, oxidized polyethylene wax, polypropylene wax and oxidized polypropylene wax, carnauba wax, fatty acid ester wax, Sasolwax, rice wax, candelilla wax, jojoba oil wax and beeswax.

A content of the releasing agent in the toner mother particles is generally 1 to 30 parts by mass relative to 100 parts by mass of the binder resin for forming the toner mother particles and preferably 5 to 20 parts by mass.

(Charge Controlling Agent)

The toner may contain a charge controlling agent. A zinc- or aluminum-metal complex of a salicylic acid derivative (salicylic acid metal complex), calixarene-based compound, organic boron compound and fluorinated quaternary ammonium salt compound may be used, for example.

A content of the charge controlling agent in the toner mother particles is generally 0.1 to 5.0 parts by mass relative to 100 parts by mass of the binder resin.

(Production Method of Toner Mother Particles)

The toner of the present invention is composed of toner mother particles added with an external additive. Examples of a method to produce the toner mother particles are kneading-pulverizing method, suspension polymerization method, emulsion aggregation method, dissolution suspension method, polyester extension method and dispersion polymerization method.

Among them, the emulsion aggregation method is preferable from the viewpoint of uniformity, shape controllability and easiness for forming a shell structure of particles which are advantageous for high definition image formation and high stability.

The emulsion aggregation method is a method for producing toner mother particles by mixing a dispersion solution of resin fine particles dispersed by a surface surfactant or dispersion stabilizing agent and dispersion solution of component(s) of the toner mother particles such as colorant fine particles as necessary, aggregating the particles by adding an aggregating agent to become desired diameter and after that or at the same time of aggregation, fusing the resin fine particles to control a shape of the fused particles.

The resin fine particles may optionally contain internal additive(s) such as a releasing agent or charge controlling agent. Or the particles may be composite particles composed of two or more layers made of resins having different compositions.

It is also preferable to form toner mother particles of a core-shell structure by adding different kind of resin fine particles at the aggregation from the viewpoint of structural design of toner.

The resin fine particles may be produced by a method such as an emulsion polymerization method, mini-emulsion polymerization method or phase inversion emulsification method and some of the methods may be applied in combination. The mini-emulsion polymerization method is preferably used when internal additive (s) are added to the resin fine particles.

A volume based mean diameter of the toner mother particles of the invention is preferably 5.0 to 8.0 μm. When the volume based mean diameter of the toner mother particles is within this range, high definition images can be obtained.

A mean circularity (shape coefficient) of the toner mother particles is 0.930 to 0.990 from the viewpoint of improving fluidity and more preferably 0.955 to 0.980.

(Measurement Method of Mean Circularity and Volume Based Mean Diameter of Toner Mother Particles)

The mean circularity and volume based mean diameter can be measured using a flow-type particle image analyzer FPIA-2100 (Sysmex Corporation). Specifically, the toner is conformed in a surfactant water solution, dispersing the solution by ultrasonic dispersion for one minute, and capturing an image using FPIA-2100 (Sysmex Corporation) under the conditions of HPF (high magnification imaging) mode and an appropriate concentration of 3000 to 10,000 HPF detection number to determine the mean circularity and volume based mean particle diameter.

The mean circularity is calculated by calculating circularity of each toner mother particles by an equation (1) below. The "circle equivalent diameter" is a diameter of a circle having the same area of a particle image.

Circularity=(length of circumference of a circle having a circle equivalent diameter)/(length of circumference of a projected particle image). Equation (1):

(External Additive)

Preferably, the toner mother particles are added on their surface with fine particles such as inorganic fine particles or organic fine particles, in addition to the fatty acid metal salt particles, as an external additive to improve charging capability and fluidity. The inorganic fine particles are preferably inorganic oxide fine particles such as silica, titania or alumina fine particles. The inorganic fine particles are preferably hydrophobically treated using a silane coupling agent or titanium coupling agent.

A polymer such as a polystyrene, poly-methyl methacrylate, or styrene-methyl methacrylate copolymer may be used for the organic fine particles.

An amount of the inorganic or organic fine particles is preferably 0.05 to 5 parts by mass relative to 100 parts by mass of the toner mother particles and more preferably 0.1 to 3 parts by mass.

(Metal Oxide Fine Particles)

It is preferable to add metal oxide fine particles having high abrasive effect to the toner of the present invention to enhance abrasive effect of a surface of an electrophotographic photoreceptor. Examples of the metal oxide fine particles having high abrasive effect are preferably silica fine particles, alumina fine particles, cerium oxide fine particles, calcium titanate fine particles and strontium titanate fine particles having a number based mean primary particle diameter of 100 to 300 nm. Among them, calcium titanate fine particles and strontium titanate fine particles are particularly preferable. The metal oxide fine particles, by being contained in the toner particles as an external additive, deposit as an abrasive at the tip portion of a cleaning blade and refresh a surface of an electrophotographic photoreceptor. The metal oxide fine particles also polish the excessive fatty acid metal salt spread on an electrophotographic photoreceptor and suppress generation of black-spot-type image defects on the electrophotographic photoreceptor and remove discharge product. In addition, the metal oxide fine particles control fluidity and charging capability of the toner. A content of the metal oxide fine particles having abrasive effect is 0.05 to 5 parts by mass relative to 100 parts by mass of the toner mother particles and preferably 0.1 to 3 parts by mass.

The metal oxide fine particles are preferably surface-treated with a silane coupling agent, titanium coupling agent, higher fatty acid or silicone oil from the viewpoint of heat resistant shelf life and environmental stability.

(Method for Adding External Additive)

An external additive adding step is a step to add and mix an external additive with dried toner mother particles so as to prepare toner particles.

A dry addition method is an example of addition of external additive, in which a powdered external additive is added with dried toner mother particles. A mechanical mixing machine such as Henschel mixer or coffee mil is an example as a mixing machine.

In the present invention, the fatty acid metal salt particles are preferably added and mixed in two steps to control the particle diameter distribution of the fatty acid metal salt particles. In concrete, preferably, fatty acid metal salt particles having a peak on a smaller-size side are added at first and mixed, and then fatty acid metal salt particles having a peak on a larger-size side are added and mixed. An external additive such as metal oxide fine particles other than the fatty acid metal salt particles may be added and mixed at any stage in the two steps.

(Developer)

The toner of the invention may be used as a two-component developer by mixing with a carrier as well as a single-component magnetic or nonmagnetic developer. When using the toner of the invention as a two-component developer, magnetic particles composed of a known material such as a metal, e.g. iron, ferrite and magnetite and an alloy of the metal and aluminum or lead may be used as a carrier. Particularly, ferrite particles are preferable. It is possible to use a resin-coated carrier (coat carrier) which magnetic particles are coated with a coating agent such as a resin or a binder-type carrier which magnetic fine particles are dispersed in binder resin as a carrier.

A coating resin forming the resin-coated carrier is not limited and olefin resins, styrene resins, styrene-acrylic resin, acrylic resin, silicone resin, ester resins and fluorine resins are exemplified. As a binder resin forming the binder-type carrier, any known resin may be used and styrene-acrylic resin, polyester resins, fluorine resins and phenol resins are exemplified. Among them, a resin-coated carrier coated with styrene-acrylic resin or acrylic resin is preferable from the viewpoint of charging capability and durability.

A carrier preferably has a volume based mean particle diameter of 20 to 100 μm because it causes high definition images and it suppresses carrier adhesion and more preferably 25 to 80 μm. A volume based mean particle diameter of a carrier can be measured by a laser diffraction particle size distribution analyzer "HELOS" (Sympatec GmbH) provided with a wet disperser as a representative.

(Electrophotographic Image Forming Method)

The toner for electrostatic latent image development of the invention can be used in various known electrophotographic image forming methods such as a monochrome image forming method or full-color image forming method. In the full-color image forming method, the toner may be used in both of a four-cycles image forming method that is carried out using four color developing devices for yellow, magenta, cyan and black and one electrophotographic photoreceptor (also referred to simply as a "photoreceptor") and a tandem-type image forming method using image forming units for the colors each having a color developing device and an electrophotographic photoreceptor for each color.

Specifically, an electrophotographic image forming method includes a step of charging an electrophotographic photoreceptor, a step of exposing to form an electrostatic latent image on the electrophotographic photoreceptor, a step of developing the latent image to form a toner image using the toner of the invention for developing the electrostatic latent image, a step of transferring the toner image on a transfer medium, and a step of cleaning the electrophotographic photoreceptor using a cleaning blade after transferring the toner image.

A toner remained on the electrophotographic photoreceptor without transferred on a transfer medium (transfer residue toner) is removed (cleaned) by a cleaning blade in the cleaning step to proceed next image formation.

Various kinds of charging methods may be employed for a charging step to charge an electrophotographic photoreceptor. In particular, for the present invention, a roller charging is preferable from a viewpoint of down-sizing and simplification of a device.

The toner of the invention has a feature that the toner contains fatty acid metal salt particles, and a volume based particle diameter distribution of the fatty acid metal salt particles has two peaks on a side of smaller size and a side of larger size, respectively. The peak on the smaller-size side is 3.0 μm or smaller and the peak on the larger-size side stands on a position larger than a volume based mean particle diameter of the toner mother particles.

According to the method for producing an electrophotographic image of the invention, an electrophotographic photoreceptor has a surface protective layer on a photosensitive layer and the surface protective layer contains metal oxide fine particles and a resin that is obtained by polymerizing a cross-linking polymerizable compound. The metal oxide fine particles are one of silica fine particles, titania fine particles and tin oxide fine particles. When a photoreceptor has a surface protective layer on a photosensitive layer and the surface protective layer contains metal oxide fine particles and a resin that is obtained by polymerizing a cross-linking polymerizable compound, it becomes possible to obtain good cleaning capability, suppress one-sided wearing of the photoreceptor and the cleaning blade, and obtain excellent images constantly without degrading the cleaning blade's life when used with the toner for electrostatic latent image development of the invention.

(Electrophotographic Photoreceptor)

The electrophotographic photoreceptor of the invention has a photosensitive layer on an electro-conductive support and has a surface protective layer on the photosensitive layer.

The photosensitive layer may be a single layer containing a charge generating material and a charge transporting material. Or the photosensitive layer may be a separated-function-type layer composed of two layers of a charge generating layer containing a charge generating material and a charge transporting layer containing a charge transporting material.

The surface protective layer can be high wearing resistant by containing metal oxide fine particles and a resin that is obtained by polymerizing a cross-linking polymerizable compound.

The cross-linking polymerizable compound is preferably a radical polymerizable compound, and particularly a multi-functional radical polymerizable compound having an acryloyl group or methacryloyl group.

The metal oxide fine particles are preferably treated with a surface treating agent. The surface treating agent is preferably a silane coupling agent having a radical polymerizable functional group.

The surface protective layer may be formed by preparing an application liquid which a cross-linking polymerizable compound, metal oxide fine particles and an optional polymerization initiator are dissolved and mixed in an organic solvent, applying the liquid onto a photosensitive layer and polymerizing the liquid by light or heat.

According to the present invention, it is possible to provide a toner for electrostatic latent image development that is capable of suppressing wearing (abrasion) of a cleaning blade, causes no insufficient cleaning or image defect of black spots due to one-sided wearing of the cleaning blade and photoreceptor and can form fine images constantly, a method for producing the toner for electrostatic latent image development and a method for forming an electrophotographic image using the toner for electrostatic latent image development.

It is not clear what kind of mechanism causes the effect of the invention but the inventors of the invention suppose as follows.

The fatty acid metal salt particles are positively-charged particles in general. When the fatty acid metal salt particles have diameters similar to that of the toner particles or larger, the fatty acid metal salt particles can exist free from the toner particles without adhering the toner. The fatty acid metal salt particles adhere to a non-image portion on the photoreceptor when developed and are spread on the non-image portion on the photoreceptor.

On the other hand, when the fatty acid metal salt particles have diameters smaller than that of the toner mother particles, the fatty acid metal salt particles adhere to the toner particles and are developed with the toner particles, adhere to an image portion on the photoreceptor by the cleaning blade and spread on the image portion on the photoreceptor.

If the fatty acid metal salt particles contained in the toner have only smaller-sized particles or larger-sized particles, the fatty acid metal salt particles are supplied in the image portion or non-image portion only and it causes unevenness of lubricant application condition on the photoreceptor. When the toner contains the fatty acid metal salt particles having smaller-sized particles and larger-sized particles, lubricant can be provided on the photoreceptor evenly as if a lubricant supply system was used. Therefore, constant supply of lubricant can be achieved without complicated devices and thus a life of cleaning blade is not reduced, insufficient cleaning due to one-sided wearing of the cleaning blade and photoreceptor does not occur and fine images without image defect of black spots can be obtained stably.

EXAMPLES

The present invention will be explained using an example without an intention to limit the present invention to the example. In the explanation the expressions of "part" and "%" mean "part by mass" and "% by mass", respectively, unless otherwise defined.

(Production of Photoreceptor)

(1) Preparation of Conductive Support

A conductive support (1) was prepared by cutting a cylindrical aluminum body.

(2) Formation of Intermediate Layer

An intermediate layer forming application liquid (1) was prepared in batch-wise by dispersing following raw materials for 10 hours using a sand mil.

Binder resin: Polyamide resin "X1010" (Daicel-Evonik Ltd.)

1.0 part by mass

Metal oxide fine particles: Titanium oxide fine particles "SMT 500 SAS" having number based mean primary particle diameter of 0.035 μm (TAYCA) 1.1 parts by mass Solvent: Ethanol 20.0 parts by mass The application liquid (1) for forming an intermediate layer was coated on the conductive support (1) by a dip coating method to form a coating film and the film was dried for 20 minutes at 110° C. to form an intermediate layer (1) having a dry-thickness of 2.0 μm.

(3) Formation of Photosensitive Layer (Formation of Charge Generating Layer)

A charge generating layer forming application liquid (1) was prepared by dispersing following raw materials for 10 hours using a sand mil as a disperser.

Charge generating material: Titanyl phthalocyanine pigment (having a maximum diffraction peak at least a position of 27.3° in an X-ray diffraction spectrum by a Cu—Kα characteristic X ray.) 20 parts by mass Binder resin: Poly-vinylbutyral resin "#6000-C" (Denki Kagaku Kogyo Kabushiki Kaisha) 10 parts by mass Solvent: t-butylacetate 700 parts by mass Solvent: 4-methoxy-4-methyl-2-pentanone 300 parts by mass The application liquid was coated on the intermediate layer 1 by a dip coating method to form the charge generating layer 1 having a thickness of 0.8 μm.

(Formation of Charge Transporting Layer)

A charge transporting layer forming application liquid (1) was prepared by mixing and dissolving following raw materials.

Charge transporting material: Compound expressed by a following formula (A) 150 parts by mass Binder resin: Polycarbonate resin "Z300" (Mitsubishi Gas Chemical Company) 300 parts by mass Solvent: Toluene/tetrahydrofuran=1/9 (by volume) 2000 parts by mass Antioxidant: Irganox 1010 (BASF Japan Ltd.) 6 parts by mass Leveling agent: Silicone oil "KF-54" (Shin-Etsu Chemical Co., Ltd.) 1 part by mass An application film was formed by applying the application liquid (1) for forming a charge transporting layer on the charge generating layer (1) using a dip coating method. The application film was dried for 60 minutes at 110° C. to forma charge transporting layer (1) having a thickness of 20 μm.

(Chemical formula 1)

FORMULA (A)

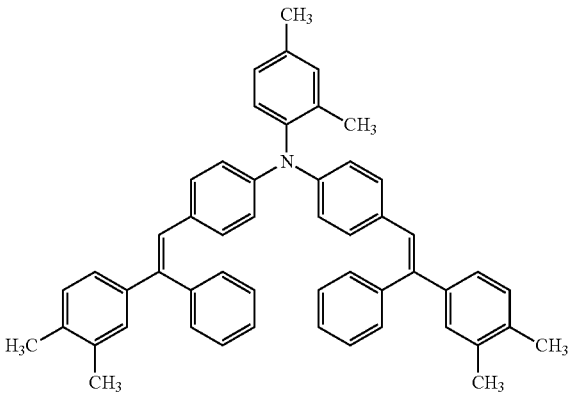

(4) Formation of Surface Protecting Layer

Cross-linking polymerizable compound: Compound represented by a formula (B) below 100 parts by mass Solvent: Isopropylalcohol 500 parts by mass Metal oxide fine particles: Titania fine particles having a number based mean primary particle diameter of 6 nm treated with a surface treatment agent ($CH_2{=}C(CH_3)COO(CH_2)_2Si(OCH_3)_3$) 100 parts by mass (Chemical formula 2)

FORMULA (B)

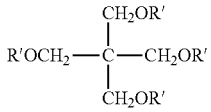

(In the formula, R' represents methacryloyl group.)

The above polymerizable compound, solvent and metal oxide fine particles were dispersed under light-shielded circumstance for 10 hours using a sand mil as a disperser, and then a polymerization initiator (Irgacure 369) (BASF Japan Ltd.) was added by 30 parts by mass and mixed and stirred under light-shielded circumstance to prepare a surface protecting layer forming application liquid (1).

The application liquid (1) for forming a surface protecting layer was applied on the charge transporting layer (1) using a circular sliding hopper application device (circular quantity-control-type applicator) to form an application film. The application film was dried at a room temperature for 20 minutes and ultraviolet ray was irradiated for one minute while a photoreceptor was rotated using a metal-halide lamp (500 W) positioned such that a distance between the light source and the surface of the photoreceptor became 100 mm to form the surface protecting layer (1) having a thickness of 3 μm. The photoreceptor is designated as a photoreceptor (1).

(Toner Producing Method)

(Production of Toner 1)

(1) Production of Resin Fine Particles (Preparation Step of Dispersion Liquid for Core Resin Fine Particles (1))

Resin fine particles (1) for core portion (referred to also as "core resin fine particles (1)") having a multilayered structure were prepared through a first stage polymerization, a second stage polymerization and a third stage polymerization as explained below.

(a) First Stage Polymerization (Preparation of Dispersion Solution of Resin Fine Particles (A1))

A surfactant solution which 4 parts by mass of sodium polyoxyethylene-2-dodecyl ether sulfate was dissolved in 3040 parts by mass of ion exchanged water was put into a reaction vessel equipped with a stirrer, temperature sensor, cooling coil and nitrogen inlet device. The solution was heated up to 80° C. of internal temperature while stirring the solution at a rate of 230 rpm with nitrogen flow. The surfactant solution was added with a polymerization initiator solution which 10 parts by mass of polymerization initiator (potassium persulfate: KPS) was added in 400 parts by mass of ion exchanged water and the temperature was set at 75° C. After that a monomer mixed solution containing 532 parts by mass of styrene, 200 parts by mass of n-butyl acrylate, 68 parts by mass of methacrylic acid and 16.4 parts by mass of n-octyl mercaptan was dropped into the surfactant solution over 1 hour and then the system was heated and stirred at 75° C. for 2 hours for polymerization (the first stage polymerization) to prepare a dispersion solution of resin fine particles (A1). A weight average molecular weight (Mw) of the resin fine particles (A1) prepared by the first stage polymerization was 16,500.

Measurement of the weight average molecular weight (Mw) was conducted as follows. Tetrahydrofuran (THF) as a carrier solvent was used at a flow rate of 0.2 ml/min using a device "HLC-8220" (Tosoh Corporation) with a column "TSK guard column+TSKgel Super HZM-M, 3 series" (Tosoh Corporation) keeping a temperature at 40° C. A sample solution was prepared by dissolving a measurement sample in tetrahydrofuran so as to be a concentration of 1 mg/ml using a ultrasonic disperser for 5 minutes at a room temperature and the solution was filtered with a membrane filter having a pore size of 0.2 μm. 10 μl of the sample solution was injected in the device with the carrier solvent and detected using a refractive index detector (RI detector). The molecular weight distribution of the sample solution was calculated using a calibration curve measured with a monodispersed polystyrene standard particles. The calibration curve was prepared using standard polystyrene samples for calibration by Pressure Chemical Company. At least ten standard polystyrene samples whose molecular weights were $6\times10^2$, $2.1\times10^3$, $4\times10^3$, $1.75\times10^4$, $5.1\times10^4$, $1.1\times10^5$, $3.9\times10^6$, $8.6\times10^5$, $2\times10^6$ and $4.48\times10^6$ were measured using a refractive index detector as a detector.

(b) Second Stage Polymerization (Preparation of Dispersion Solution of Resin Fine Particles (A2): Formation of Intermediate Layer)

In a flask equipped with a stirrer, a monomer mixed solution containing 101.1 parts by mass of styrene, 62.2 parts by mass of n-butylacrylate, 12.3 parts by mass of methacrylic acid, and 1.75 parts by mass of n-octylmercaptan was added with 93.8 parts by mass of paraffin wax "HNP-57" (Nippon Seiro Co., Ltd.) as a releasing agent and dissolved at a temperature of 90° C.

A surfactant solution was prepared by dissolving 3 parts by mass of sodium polyoxyethylene-2-dodecyl ether sulfate into 1560 parts by mass of ion exchanged water and the solution was heated up to 98° C. To this surfactant solution, 32.8 parts by mass (converted as solid content) of the dispersion solution of the resin fine particles (A1) was added. The monomer mixed solution containing the paraffin wax was mixed with the solution and dispersed using a mechanical disperser "Clearmix" (M Technique Co., Ltd.) having a circulation pathway for 8 hours to prepare a dispersion solution containing emulsified particles having a dispersed diameter of 340 nm. A polymerization initiator solution which 6 parts by mass of potassium persulfate was dissolved in 200 parts by mass of ion exchanged water was added to the emulsified particles dispersed solution and the system was heated and stirred for 12 hours at 98° C. for polymerization (second stage polymerization) to prepare a dispersion solution of resin fine particles (A2). A weight average molecular weight (Mw) of the resin fine particles (A2) prepared by the second stage polymerization was 23,000.

(c) Third Stage Polymerization (Preparation of Dispersion Solution of Core Resin Fine Particles (1): Formation of Outer Layer)

A polymerization initiator solution which 5.45 parts by mass of potassium persulfate was dissolved into 220 parts by mass of ion exchanged water was added to the above resin particles (A2) and then a monomer mixed solution containing 293.8 parts by mass of styrene, 154.1 parts by mass of n-butyl acrylate and 7.08 parts by mass of n-octyl mercaptan was dropped into the solution over 1 hour at 80° C. After that the solution was heated and stirred for 2 hours for polymerization (third stage polymerization) and then cooled to 28° C. to prepare a dispersion solution of core resin fine particles (1). A weight average molecular weight (Mw) of the core resin fine particles (1) was 26,800. A volume based mean particle diameter of the core resin fine particles (1) was 125 nm. A glass transition temperature (Tg) of the core resin fine particles (1) was 30.5° C.

(Preparation Step of Dispersion Solution of Shell Layer Resin Fine Particles (1))

A dispersion solution of resin fine particles (1) for shell layer (referred to also as "dispersion solution of shell layer resin fine particles (1)") was prepared by the same way of polymerization and treatment after polymerization as those of the first stage polymerization for preparation of the core resin fine particles (1) except that 548 parts by mass of styrene, 156 parts by mass of 2-ethylhexyl acrylate, 96 parts by mass of methacrylic acid and 16.5 parts by mass of n-octyl mercaptan were used as a monomer mixed solution. A glass transition temperature of the shell layer resin fine particles (1) was 49.8° C.

(2) Preparation of Dispersion Solution of Colorant Fine Particles (1)

90 parts by mass of sodium dodecyl sulfate was added to 1600 parts by mass of ion exchanged water and 420 parts by mass of carbon black "Regal 330R" (Cabot Corporation) was gradually added to the solution while stirring the solution. The solution was then dispersed using a mixer "Clearmix" (M Technique Co., Ltd.) to prepare a colorant fine particles dispersion solution (1) in which colorant fine particles were dispersed.

A diameter of the colorant fine particles of the colorant fine particles dispersion solution (1) was determined as 110 nm by using electrophoresis light scattering photometer "ELS-800" (Otsuka Electronics Co., Ltd.).

(3) Preparation of Toner Particles (a) Formation of Core Portion 420 parts by mass (converted as solid content) of dispersion solution of the core resin fine particles (1), 900 parts by mass of ion exchanged water and 100 parts by mass of the colorant fine particles dispersion solution (1) were put into a reaction vessel equipped with a temperature sensor, cooling coil, nitrogen inlet device and stirrer and the solution was stirred. The temperature in the reaction vessel was adjusted to 30° C. and sodium hydroxide solution of 5 mol/1 was added into the solution to adjust the pH into a range from 8 to 11.

Next, a solution which 60 parts by mass of magnesium chloride hexahydrate was dissolved in 60 parts by mass of ion exchanged water was added to the dispersion solution over 10 minutes at 30° C. while stirring. After 3 minutes standing, heating of the system was started and continued for 80 minutes until it became 80° C. (core portion forming temperature). A diameter of the particles was determined in this state using a flow-type particle image analyzer "FPIA 2100" (Sysmex Corporation) and when the volume based mean diameter of the particles became 5.8 μm, a solution which 40.2 parts by mass of sodium chloride was dissolved in 1000 parts by mass of ion exchanged water was added to cease the particle growth. The solution was further heated and stirred at 80° C. (core portion aging temperature) for one hour as an aging treatment so as to continue fusion to form the core portion (1). A circularity of the core portion (1) was determined as 0.930 using a flow-type particle image analyzer "FPIA 2100" (Sysmex Corporation). It was confirmed that the colorant was dissolved in the binder resin and no colorant dispersion fine particles were remained in the core portion (1) by a scanning transmission electron microscope method of 10000 magnification using a field emission scanning electron microscope "JSM-7401F" (JEOL Ltd.).

(b) Formation of Shell Layer

Next, 46.8 parts by mass (converted as solid content) of the dispersion solution of shell layer resin fine particles (1) was added at a temperature of 65° C. and a solution which 2 parts by mass of sodium chloride hexahydrate was dissolved in 60 parts by mass of ion exchanged water was added over 10 minutes. After that, the solution was heated up to 80° C. (shell-forming temperature), kept stirring for one hour to fuse the shell layer resin fine particles (1) on the surface of the core portion (1). After that the solution was kept at 80° C. (shell-aging temperature) for aging treatment until the circularity became predetermined value to form a shell layer. A solution which 40.2 parts by mass of sodium chloride was dissolved in 1000 parts by mass of ion exchanged water was added, cooled down to 30° C. at a rate of 8° C./min, and the fused particles were filtered, washed by ion exchanged water at 45° C. repeatedly and dried by hot wind at 40° C. to obtain toner mother particles (1) having the shell layer at the surface of the core portion. A volume based mean diameter and Tg of the toner mother particles (1) were 5.9 μm and 31° C., respectively. A mean circularity of the toner mother particles (1) was 0.960.

(Addition of External Additive)

100 parts by mass of the toner mother particles (1) was added with 0.12 part by mass of zinc stearate particles ("MZ-2", volume based mean particle diameter 2.0 μm: NOF Corporation) as fatty acid metal salt particles having a peak on a smaller-size side and they were mixed using Henschel mixer "FM10B" (MitsuiMiike Kakouki Corporation) for 3 minutes at 15 m/sec of peripheral speed of agitation impeller at 30° C. Next, 0.75 part by mass of small-sized silica fine particles ("RX-200", fumed silica, HMDS treated, number based mean particle diameter 12 nm: Nippon Aerosil Co., Ltd.), 1.50 parts by mass of spherical silica fine particles ("X-24 9600", produced by sol-gel method, HMDS treated, number based mean particle diameter 80 nm: Shin-Etsu Chemical Co., Ltd.), 0.08 part by mass of zinc stearate particles ("ZnSt-S"; NOF Corporation, adjusted to have a volume based mean particle diameter 10.0 μm) as fatty acid metal salt fine particles having a peak on a larger-size side and 0.5 part by mass of calcium titanate particles ("TC110", number mean primary particle diameter 300 nm, silicone oil treated, Titan Kogyo, Ltd.) as a metal oxide fine particles having high abrasion performance, and the mixture was mixed using Henschel mixer "FM10B" (MitsuiMiike Kakouki Corporation) for 15 minutes at 40 m/sec of peripheral speed of agitation impeller at 30° C. and coarse particles were removed using a sieve having an open mesh-size of 90 μm to prepare a toner 1.

(Preparation of Toner 2 to Toner 21)

Toner 2 to toner 21 were prepared by the same way as that of the toner 1 except that the volume based mean particle diameter of the mother toner particles, metal oxide fine particles having high abrasion performance and the type and added amount of the fatty acid metal salt fine particles were changed as shown in Table 1.

(Table 1)

TABLE 1

| | TONER MOTHER PARTICLES | METAL OXIDE FINE PARTICLES | | | FATTY ACID METAL SALT PARTICLES HAVING PEAK ON SMALLER-SIZE SIDE | | |
|---|---|---|---|---|---|---|---|
| TONER No. | VOLUME BASED MEAN PARTICLE DIAMETER [μm] | TYPE | DIAMETER [nm] | ADDED AMOUNT/ PART BY MASS | TYPE | VOLUME BASED MEAN PARTICLE DIAMETER [μm] | ADDED AMOUNT/ PART BY MASS |
| TONER 1 | 5.9 | CALCIUM TITANATE | 300 | 0.50 | ZnSt | 2.0 | 0.12 |
| TONER 2 | 5.9 | CALCIUM TITANATE | 200 | 0.50 | ZnSt | 2.0 | 0.12 |
| TONER 3 | 5.9 | CALCIUM TITANATE | 100 | 0.50 | ZnSt | 3.0 | 0.12 |
| TONER 4 | 5.9 | CALCIUM TITANATE | 200 | 2.00 | ZnSt | 1.0 | 0.005 |
| TONER 5 | 5.9 | CALCIUM TITANATE | 300 | 3.00 | ZnSt | 2.0 | 0.35 |
| TONER 6 | 5.9 | CALCIUM TITANATE | 200 | 0.50 | MgSt | 3.0 | 0.30 |
| TONER 7 | 5.0 | CALCIUM TITANATE | 100 | 0.50 | ZnSt | 2.0 | 0.35 |
| TONER 8 | 8.0 | STRONTIUM TITANATE | 300 | 0.50 | ZnSt | 2.0 | 0.25 |
| TONER 9 | 5.9 | STRONTIUM TITANATE | 150 | 1.00 | ZnSt | 1.8 | 0.14 |
| TONER 10 | 5.9 | CALCIUM TITANATE | 100 | 1.05 | ZnSt | 2.0 | 0.20 |
| TONER 11 | 5.9 | NONE | — | — | ZnSt | 2.0 | 0.40 |
| TONER 12 | 7.9 | CALCIUM TITANATE | 100 | 0.50 | ZnSt | 2.0 | 0.12 |
| TONER 13 | 5.9 | STRONTIUM TITANATE | 100 | 0.50 | ZnSt | 2.0 | 0.12 |
| TONER 14 | 8.0 | CALCIUM TITANATE | 300 | 0.50 | ZnSt | 3.0 | 0.10 |
| TONER 15 | 5.0 | CALCIUM TITANATE | 300 | 0.50 | ZnSt | 1.8 | 0.13 |
| TONER 16 | 8.0 | CERIUM OXIDE | 500 | 3.00 | ZnSt | 1.2 | 0.14 |
| TONER 17 | 5.9 | STRONTIUM TITANATE | 50 | 0.01 | ZnSt | — | 0.00 |
| TONER 18 | 5.9 | CALCIUM TITANATE | 300 | 0.50 | ZnSt | 3.8 | 0.20 |

TABLE 1-continued

| | | | | | | | |
|---|---|---|---|---|---|---|---|
| TONER 19 | 5.9 | CALCIUM TITANATE | 200 | 5.00 | ZnSt | 1.5 | 0.20 |
| TONER 20 | 5.9 | CALCIUM TITANATE | 100 | 0.05 | ZnSt | — | 0.00 |
| TONER 21 | 5.9 | CALCIUM TITANATE | 100 | 0.05 | ZnSt | 3.3 | 0.12 |

| | FATTY ACID METAL SALT PARTICLES HAVING PEAK ON LARGER-SIZE SIDE | | | ADDED AMOUNT | RATIO OF |
|---|---|---|---|---|---|
| TONER No. | TYPE | VOLUME BASED MEAN PARTICLE DIAMETER [μm] | ADDED AMOUNT/ PART BY MASS | OF FATTY ACID METAL SALT PARTICLES/ PART BY MASS | SMALLER-SIZE-PARTICLE COMPONENT [%] |
| TONER 1 | ZnSt | 10.0 | 0.08 | 0.20 | 60 |
| TONER 2 | ZnSt | 6.0 | 0.08 | 0.20 | 60 |
| TONER 3 | ZnSt | 10.0 | 0.08 | 0.20 | 60 |
| TONER 4 | ZnSt | 10.0 | 0.005 | 0.01 | 50 |
| TONER 5 | ZnSt | 15.0 | 0.15 | 0.50 | 70 |
| TONER 6 | MgSt | 15.0 | 0.20 | 0.50 | 60 |
| TONER 7 | ZnSt | 12.0 | 0.15 | 0.50 | 70 |
| TONER 8 | ZnSt | 12.0 | 0.25 | 0.50 | 50 |
| TONER 9 | LiSt | 10.0 | 0.06 | 0.20 | 70 |
| TONER 10 | ZnSt | 10.0 | 0.30 | 0.50 | 40 |
| TONER 11 | ZnSt | 10.0 | 0.10 | 0.50 | 80 |
| TONER 12 | ZnSt | 8.0 | 0.08 | 0.20 | 60 |
| TONER 13 | ZnSt | 20.0 | 0.08 | 0.20 | 60 |
| TONER 14 | ZnSt | 6.0 | 0.10 | 0.20 | 50 |
| TONER 15 | ZnSt | 5.0 | 0.07 | 0.20 | 65 |
| TONER 16 | ZnSt | 7.0 | 0.06 | 0.20 | 70 |
| TONER 17 | ZnSt | 20.0 | 0.20 | 0.20 | 0 |
| TONER 18 | ZnSt | — | 0.00 | 0.20 | 100 |
| TONER 19 | ZnSt | — | 0.00 | 0.20 | 100 |
| TONER 20 | ZnSt | 10.0 | 0.20 | 0.20 | 0 |
| TONER 21 | ZnSt | 10.0 | 0.08 | 0.20 | 60 |

ADDED AMOUNT (PART BY MASS): ADDED AMOUNT RELATIVE TO 100 PARTS BY MASS OF TONER MOTHER PARTICLES
ZnSt: ZINC STEARATE/MgSt: MAGNESIUM STEARATE/LiSt: LITHIUM STEARATE (Preparation of Developer)

Developers 1 to 21 were produced by mixing each of the toners 1 to 21 and a ferrite carrier 1 such that a toner concentration became 6.0% by mass. The ferrite carrier was made by being coated with a copolymer resin of a cyclohexyl methacrylate and a methyl methacrylate (monomer ratio=1:1) and a volume based median diameter thereof was 33 μm.

(Evaluation Method)

(Image Defect Incidence)

Image defect incidence was evaluated using a modified digital full-color multi-functional peripherals "bizhub C360" (Konica Minolta, Inc) in which charging means was modified to roller charging system. The photoreceptor (1) and each of the developers 1 to 21 were loaded in turn and an image of 10% of pixel rate was printed continuously on 1,000 sheets of A4 high grade paper (64 g/m$^2$) under the condition of 30° C. and 85% RH. The number of prints which a black spot was generated in the print was count and the image defect incidence was calculated. When the image defect incidence is not more than 0.5%, there is no practical problem.

(Judgment Criteria)

○: No image defect

Δ: Image defect incidence less than 0.5%

X: Image defect incidence 0.5% or more (Cleaning Capability)

Cleaning capability was evaluated using a modified digital full-color multi-functional peripherals "bizhub C360" (Konica Minolta, Inc) in which charging means was modified to roller charging system. The photoreceptor (1) and each of the developers 1 to 21 were loaded in turn and an image of 5% of pixel rate was printed on 100,000 sheets of A4 high grade paper (64 g/m$^2$) under the condition of 10° C. and 10% RH. A filled-in image (grid voltage: 450 V, developing potential: 350 V) was output and evaluated. If toner escaping on an image was not observed, there is no practical problem.

(Judgment Criteria)

○: No toner escaping

Δ: Toner escaping on a photoreceptor, no toner escaping on an image

X: Toner escaping on an image (Blade Abrasion)

An abrasion of the cleaning blade was observed using a laser microscope after 100,000 printings in the above cleaning capability evaluation. If image defect caused by insufficient cleaning did not occur, there is no practical problem.

(Judgment Criteria)

○: No chipping or one-sided abrasion

Δ: Chipping or one-sided abrasion is partially observed but image defect caused by insufficient cleaning is not observed X: Chipping or one-sided abrasion is observed and image defect caused by insufficient cleaning is observed The above results were shown in Table 2.

(Table 2)

TABLE 2

| TONER No. | EVALUATION IMAGE DEFECT INCIDENCE | CLEANING CAPABILITY | BLADE ABRASION AFTER 100,000 PRINTS | REMARKS |
|---|---|---|---|---|
| TONER 1 | ○ | ○ | ○ | PRESENT INVENTION |
| TONER 2 | ○ | ○ | Δ | PRESENT INVENTION |
| TONER 3 | ○ | ○ | ○ | PRESENT INVENTION |
| TONER 4 | ○ | ○ | ○ | PRESENT INVENTION |
| TONER 5 | ○ | ○ | ○ | PRESENT INVENTION |
| TONER 6 | ○ | ○ | ○ | PRESENT INVENTION |
| TONER 7 | ○ | ○ | ○ | PRESENT INVENTION |
| TONER 8 | ○ | ○ | ○ | PRESENT INVENTION |
| TONER 9 | ○ | ○ | ○ | PRESENT INVENTION |
| TONER 10 | ○ | ○ | Δ | PRESENT INVENTION |
| TONER 11 | ○ | Δ | Δ | PRESENT INVENTION |
| TONER 12 | ○ | Δ | Δ | PRESENT INVENTION |
| TONER 13 | ○ | ○ | Δ | PRESENT INVENTION |
| TONER 14 | X | X | X | COMPARATIVE EXAMPLE |
| TONER 15 | X | X | X | COMPARATIVE EXAMPLE |
| TONER 16 | X | X | X | COMPARATIVE EXAMPLE |
| TONER 17 | X | X | X | COMPARATIVE EXAMPLE |
| TONER 18 | ○ | X | X | COMPARATIVE EXAMPLE |
| TONER 19 | ○ | X | X | COMPARATIVE EXAMPLE |
| TONER 20 | X | X | X | COMPARATIVE EXAMPLE |
| TONER 21 | Δ | X | X | COMPARATIVE EXAMPLE |

As can be seen by Table 2, the toners 1 to 13 of the invention as a toner for electrostatic latent image development had excellent cleaning property and could obtain fine images stably with very low image defect incidence compared with the toners 14 to 21 as comparative examples. The abrasion of the cleaning blade after 100,000 printings was also excellent.

EXPLANATION OF SYMBOLS a particle size distribution of general fatty acid metal salt particles b particle size distribution of fatty acid metal salt particles having two peaks on a smaller-size side and a larger-size side P1 peak on a smaller-size side P2 peak on a larger-size side D particle size at the minimum value The present U.S. patent application claims the benefit of priority under the Paris Convention of Japanese Patent Application No. 2013-109533 filed on May 24, 2013 and the entire contents of which are incorporated herein by reference.

What is claimed is:

1. A toner for electrostatic latent image development, comprising toner particles that comprises toner mother particles and an external additive, wherein;

the external additive comprises fatty acid metal salt particles, wherein a volume based particle diameter distribution of the fatty acid metal salt particles has two peaks on a side of smaller size and a side of larger size, respectively, and wherein a volume based mean particle diameter of the fatty acid metal salt particles having the peak on the side of smaller size is 3.0 μm or smaller and a volume based mean particle diameter of the fatty acid metal salt particles having the peak on the side of larger size is larger than a volume based mean particle diameter of the toner mother particles.

2. The toner for electrostatic latent image development of claim 1, wherein the volume based mean particle diameter of the fatty acid metal salt particles having the peak on the side of smaller size is within a range of 1.0 to 3.0 μm and the volume based mean particle diameter of the fatty acid metal salt particles having the peak on the side of larger size is within a range of 8.0 to 15.0 μm.

3. The toner for electrostatic latent image development of claim 1, wherein the fatty acid metal salt particles are at least one selected from the group consisting of zinc stearate particles, lithium stearate particles and magnesium stearate particles.

4. The toner for electrostatic latent image development of claim 1, wherein a content of the fatty acid metal salt particles is within a range of 0.01 to 0.50 part by mass relative to 100 parts by mass of the toner mother particles.

5. The toner for electrostatic latent image development of claim 1, wherein a content rate of the fatty acid metal salt particles having the peak on the side of smaller size is within a range of 50 to 70% by mass relative to whole of the fatty acid metal salt particles.

6. The toner for electrostatic latent image development of claim 1, wherein the toner particles comprise the fatty acid metal salt particles and metal oxide fine particles, wherein the metal oxide fine particles are selected from the group consisting of silica fine particles, alumina fine particles, cerium oxide fine particles, calcium titanate fine particles and strontium titanate fine particles and a number based mean primary particle diameter of the metal oxide fine particles is within a range of 100 to 300 nm.

7. The toner for electrostatic latent image development of claim 1, wherein a volume based mean particle diameter of the toner mother particles is within a range of 5.0 to 8.0 μm.

8. A method for producing the toner for electrostatic latent image development of claim 1, comprising:

mixing fatty acid metal salt particles, into toner mother particles, having a volume based mean particle diameter smaller than a volume based mean particle diameter of the toner mother particles, and mixing fatty acid metal salt particles having a volume based mean particle diameter larger than the volume based mean particle diameter of the toner mother particles.

9. A method for forming an electrophotographic image comprising:

charging an electrophotographic photoreceptor, exposing so as to form an electrostatic latent image on the electrophotographic photoreceptor, developing the latent image so as to form a toner image using a negative-charged toner for developing the electrostatic latent image, transferring the toner image on a transfer medium, and cleaning the electrophotographic photoreceptor using a cleaning blade after transferring the toner image, wherein the toner for developing the electrostatic latent image is the toner for electrostatic latent image development of claim 1, and the electrophotographic photoreceptor has a surface protecting layer on a photosensitive layer, the surface protecting layer comprises metal oxide fine particles and a resin obtained by polymerizing a cross-linking-type polymerizable compound, and the metal oxide fine particles are selected from the group consisting of silica fine particles, titania fine particles and tin oxide fine particles.

* * * * *